US006212743B1

(12) United States Patent
Cohen

(10) Patent No.: US 6,212,743 B1
(45) Date of Patent: Apr. 10, 2001

(54) LACES THAT THREAD EASILY AND FORM A NON-SLIP KNOT

(76) Inventor: Edwin Cohen, 5 Crestmont Rd., Binghamton, NY (US) 13905

( * ) Notice: Subject to any disclaimer, the term of this patent is extended or adjusted under 35 U.S.C. 154(b) by 0 days.

(21) Appl. No.: 09/253,708

(22) Filed: Feb. 22, 1999

(51) Int. Cl.[7] ..... A43C 9/00
(52) U.S. Cl. ..... 24/713; 24/306; 24/712
(58) Field of Search ..... 24/712, 712.1, 24/712.9, 713, 713.1, 715.3–715.7, 715.9, 34, 18; 87/6, 9; 36/50.1, 50.5

(56) References Cited

U.S. PATENT DOCUMENTS

| | | | | |
|---|---|---|---|---|
| 818,991 | * | 4/1906 | Abramson | 24/713.1 |
| 931,949 | * | 8/1909 | Morrow | 24/712 |
| 1,476,348 | * | 12/1923 | Miller | 24/712 |
| 2,477,151 | * | 7/1949 | Stapleton | 24/713 |
| 2,639,481 | * | 5/1953 | Lester | 24/713 |
| 3,110,945 | * | 11/1963 | Howe, Jr. | 24/713 |
| 3,947,928 | * | 4/1976 | Maldonado | 24/713 |
| 4,247,967 | * | 2/1981 | Swinton | 24/713 |
| 5,074,013 | * | 12/1991 | Arnold et al. | 24/306 X |
| 5,673,546 | * | 10/1997 | Abraham et al. | 24/713 X |
| 5,778,499 | * | 7/1998 | Lehrman | 24/712 |
| 5,934,599 | * | 8/1999 | Hammerslag | 36/50.5 X |
| 5,946,779 | * | 9/1999 | Chen | 24/712 |

* cited by examiner

*Primary Examiner*—Robert J. Sandy
(74) *Attorney, Agent, or Firm*—Salzman & Levy

(57) ABSTRACT

Laces for shoes, sneakers, or other wearing apparel that adjust easily, but stay tied. In one embodiment, the novel design is a flat lace having an upper and lower surface made from different materials. The surfaces have a relatively low coefficient of friction with respect to a shoe's eyelets. Upon being tied, the surfaces have a high coefficient of friction when they are in contact with one another. An alternative design includes a brush-like array of tiny fibers protruding from the lace surface. Another embodiment consists of a middle portion having material properties different from its end portions. An alternative design has two sets of opposing sides with different material properties. The inventive designs minimize the possibility of laces coming untied.

9 Claims, 4 Drawing Sheets

LACES THAT THREAD EASILY AND FORM A NON-SLIP KNOT

FIELD OF THE INVENTION

The present invention relates to laces for footwear and, more particularly, to shoe and sneaker laces that can be easily threaded, looped, and adjusted, but that retain a tight knot when tied.

BACKGROUND OF THE INVENTION

Laces can be tied tightly or loosely, depending upon the preference of the wearer. Even a custom-made shoe benefits from the adjustability provided by laces, since both the dimensions of a foot and the tightness/looseness preference can change in the course of the day. To accommodate a nearly unlimited range of foot shapes and sizes, however, a sufficient amount or a limited amount of slack must be provided.

Shoe laces present a simple engineering concept that does not always perform as planned. A shoe lace should be designed to slide easily through the eyelets or holes provided in the shoe or sneaker. This is necessary so that a proper setting of size and tension is achieved. However, once the lace is tied, it should stay tied. On close observation, it will be noted that these two requirements are diametrically opposed. Many laces, while easy to adjust, fail to stay tied, once knotted. To illustrate this problem, consider a newspaper account of a Marathon runner named John Kagwe: "Just one problem with the Nike Air Vengeance: the laces kept untying. 'And I had triple knots,' said Kagwe, of Kenya. Stopping twice to tie his shoes, and running the last four miles with the right lace flapping, Kagwe won the marathon in two hours, eight minutes, and twelve seconds through 26.2 miles in the rain . . . "

Several inventors have addressed the problem of keeping laces adequately tied. In U.S. Pat. No. 5,272,796, issued to Nichols on Dec. 28, 1993 for SLIP RESISTANT SHOE LACE AND METHOD FOR MANUFACTURING SAME, a slip resistant shoe lace is illustrated. Strands of higher frictional coefficient are woven internally of the outer perimeter of the lace, in order to provide a frictionally enhanced lace that will not slip its knot.

In U.S. Pat. No. 4,780,936, issued to Brecher on Nov. 1, 1988 for STAY-TIED SHOE LACES, a shoe and lace combination is shown that impedes the loosening of a tied lace. The tongue of a shoe is provided with a flexible band member that folds over the lace after it has been knotted. The band secures the knot from unraveling. The flexible band is itself held in its fold-over position by means of a Velcro patch disposed thereupon, that mates with a corresponding patch on a distal end thereof.

In U.S. Pat. No. 5,673,546, issued to Abraham et al. on Oct. 7, 1997 for NON-SLIP SHOELACES, a slip resistant shoe lace is illustrated. The lace features a plurality of special slip resistant yarns that contains slubs. The slubs, when woven into a lace, provide a length of material that has protuberances disposed along the length of the lace. These protuberances are meant to provide frictional "bumps" at periodic intervals, which bumps will prevent a tied lace from unravelling its knot.

None of these lace systems, however, has addressed the concurrent problem of assuring that the laces easily slide through the eyelets or holes provided for them. Indeed, these laces will resist becoming untied once knotted, but they are now more likely to resist being threaded through the eyelets of a shoe or sneaker. Adding frictional means within the yarn solves the problem of unravelling, but exacerbates the problem of threading the lace through the eyelets of the shoe. As aforementioned, the two objectives compete with each other, and require opposite design criteria.

In present day laces, the yarn presents a compromise between the competing objectives. One is forced to choose between non-slippage and ease of threading.

The present invention is a shoe lace that is easily threaded, looped, and adjusted through the eyelets of a shoe, while at the same time is capable of forming a non-slip knot, when tied.

One embodiment of the inventive device is a flat shoe lace comprising an upper and lower surface made of different materials. The novel lace configuration performs a function similar to that of hook-on-one-side, pile-on-the-other-side fasteners. Unlike Velcro®, however, the surfaces are not designed for adhesion, but for high static friction between the upper and lower surfaces of the flat lace. When tying the flat shoe lace, both surfaces inevitably come in contact with each other. In this way, the laces resist inadvertent untying. Both the upper and lower surfaces have a low coefficient of both static and sliding friction with respect to the eyelets or holes. This enables the lace to be threaded through with minimal effort.

Alternative embodiments for obtaining high lace-to-lace friction and negligible lace-to-eyelet friction are described in detail hereinbelow.

While the various embodiments describe flat or rectangular shaped laces, the novel design approach would also be applicable to a lace with a round or oval cross-section.

SUMMARY OF THE INVENTION

In accordance with the present invention, there is provided a shoe lace that is easy to thread through the eyelets of a shoe or sneaker, and also provides a knot that does not slip, when tied. In one embodiment, the shoe lace is flat and comprises an upper and lower surface with different frictional properties. The two surfaces of the lace that are in contact with the eyelet(s) are made of yarns, the yarns being designed to be smooth and substantially friction-free with respect to the eyelets. Thus, the threading of the lace becomes smooth and easy. On the other hand, the surfaces have a higher coefficient of friction with respect to one another. Moreover, any surfaces can be roughened by introducing slubs or "friction bumps" into the weave.

The surfaces of the lace present competing and opposite holding characteristics. During the tying process, such a lace tends to grab about the frictional surfaces, since these surfaces present the greater contacting surface area. Also, as the laces are looped during the tying process, they tend to skew and present the greater frictionalized surface area to the knot vortex.

It is an object of this invention to provide an improved lace for a shoe or sneaker.

It is another object of the invention to provide a shoe lace that is easy to thread through the eyelet of a shoe or sneaker, but the knot of which resists untying or slipping open.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same number or designation throughout the figures.

DESCRIPTION OF THE PREFERRED EMBODIMENTS

Generally speaking, the invention features a flat lace, the opposing sides having a high coefficient of friction between them, while each side has a low coefficient of friction relative to the eyelets or holes through which the laces pass. This disparity in coefficients can be achieved by using a Velcro-like approach, with dissimilar configurations on the two sides of the lace.

Figure 1:
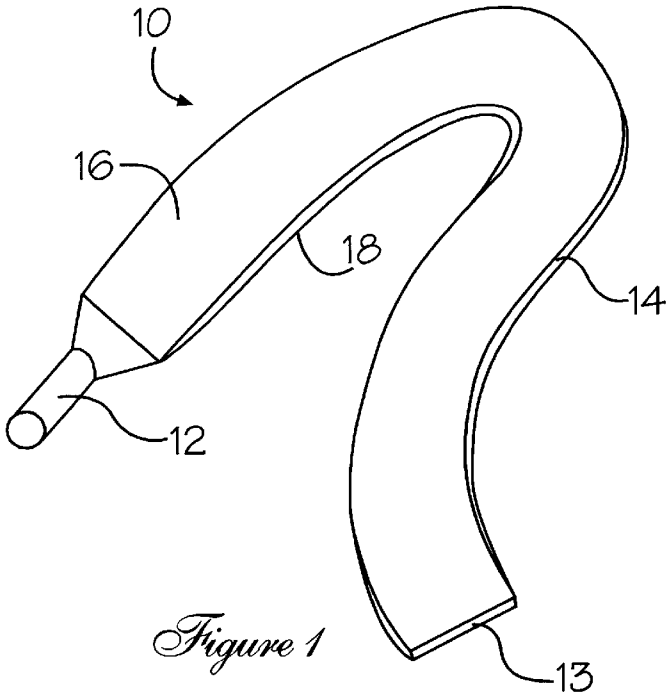
FIG. 1 illustrates a partial, enlarged, perspective view of the shoe lace of this invention.

Referring now to FIG. 1, the shoe lace 10 of this invention is illustrated in partial, enlarged, perspective view. The shoe lace 10 comprises a cylindrical, threading end cap 12 and a length of yarn 14 (shown herein cut short for viewing purposes). The length of yarn 14 is flat, as illustrated at the cut end 13. The yarn 14, itself, comprises an upper surface 16 and a lower surface 18 made of different materials bonded together either by mechanical fastening (e.g., sewing) or by an intumescent layer of adhesive, not shown. Alternatively, different materials may be affixed or sprayed to the upper and lower surfaces 16 and 18, respectively. The surfaces 16 and 18 can be made with coarse or corded fibers to increase friction. Slubs or "friction bumps" may also be introduced into the weave of the respective surfaces 16 and 18 to increase the friction thereof.

The purpose of making surfaces 16 and 18 from different materials is to provide an interface 20 (FIG. 3) having a relatively high coefficient of friction. Thus, surfaces 16 and 18 will provide non-slippage during the knotting of the yarn 14. However, the surfaces 16 and 18 both have a relatively low coefficient of friction when in contact with the inner eyelet surface 22 of a shoe, thereby allowing the lace 10 to be threaded easily, as further explained hereinbelow.

Figure 2:
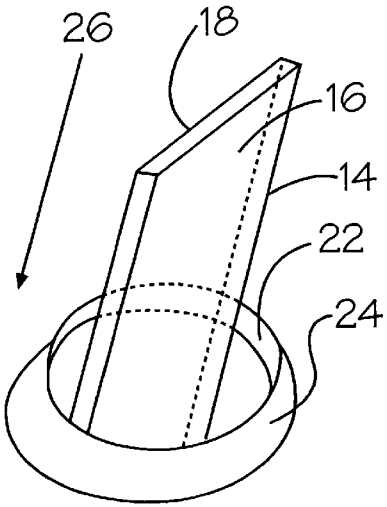
FIG. 2 depicts a partial, enlarged, perspective, in situ view of the shoe lace shown in FIG. 1, as it passes through the eyelet of a shoe.

Referring now to FIG. 2, a portion of the yarn 14 of shoe lace 10 is shown passing (arrow 26) through one eyelet 24 of a plurality of typical eyelets for a shoe or sneaker (not shown). The yarn 14 easily passes through the eyelet 24 due to the reduced friction existing between the contacting surfaces 16 or 18 and eyelet surface 22.

Figure 3:
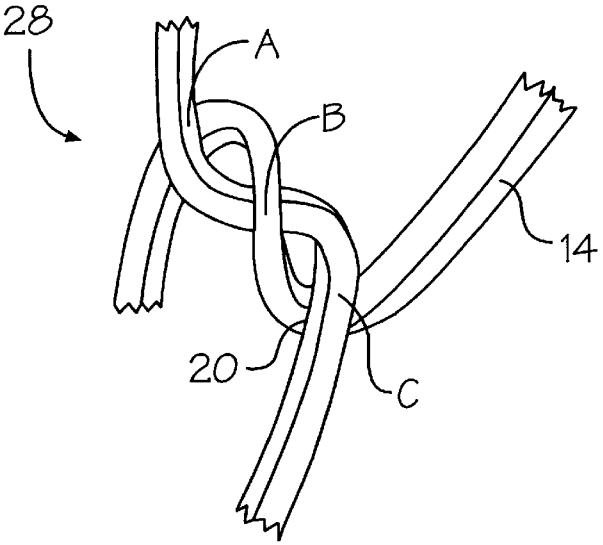
FIG. 3 shows an enlarged, perspective view of the shoe lace shoe in FIG. 1, as it is tied into a knot.

Referring to FIG. 3, the yarn 14 is shown being tied into a knot matrix 28, in keeping with tying of the lace 10 about the front of a shoe or sneaker. For purposes of forming the knot matrix 28, the upper and lower surfaces 16 and 18, respectively, come into substantial contact with each other at points "A", "B", and "C", as the knot matrix 28 is formed. Thus, the overall effect of the bifurcated frictional lace structure is to provide a knot matrix 28 that does not slip.

Figure 4:
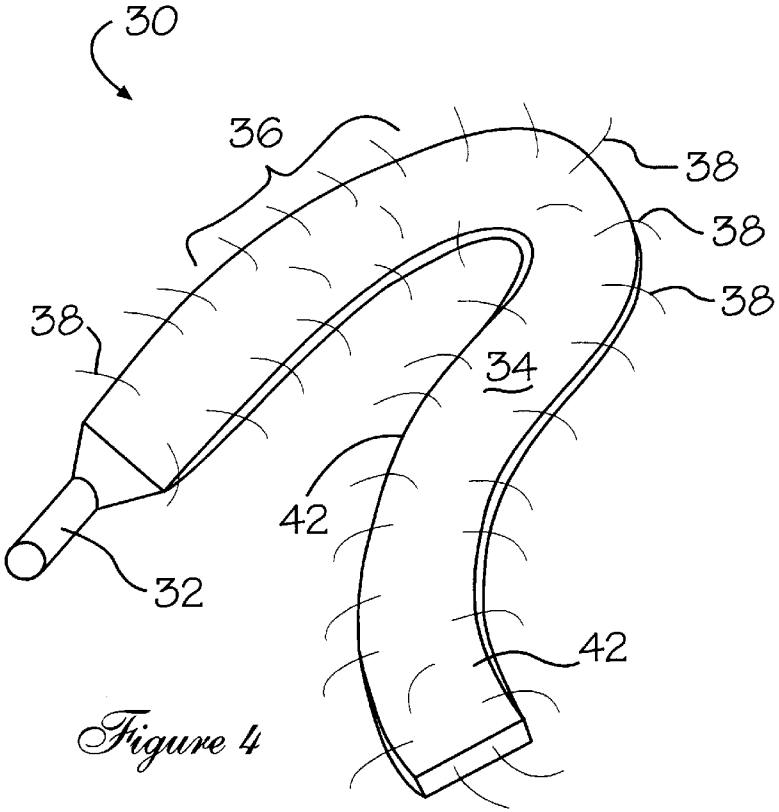
FIG. 4 illustrates a partial, enlarged, perspective view of an alternative embodiment of the present invention.

Referring now to FIG. 4, the shoe lace 30 of an alternative embodiment is illustrated in partial, enlarged, perspective view. The material used to make the lace 30 (i.e., yarn 34) is the same throughout the entire lace 30. A rectangular lace is used in this embodiment. However, flat, rounded, elliptical, or other shaped laces can incorporate the design elements described hereinbelow.

The lace 30 comprises a brush-like array 36 of tiny fibers 38 protruding from the lace surface 42. These fibers 38, having a relatively low coefficient of friction (i.e., a coefficient between that of Teflon and nylon), slide easily through the eyelet 24. At the same time, the lace 30 is resistant to sliding against itself; hence, knots in lace 30 remain tied.

The shoe lace 30 comprises a cylindrical, threading end cap 32 and a length of yarn 34 (shown herein cut short for viewing purposes). Again, slubs or "friction bumps" may be introduced into the weave to further increase the friction thereof.

The purpose of constructing the lace 30 with a brush-like array 36 of tiny fibers 38 is to provide increased surface area for contact. Fibers 38 come in contact with one another and with the lace surface 42. Increasing the surface area increases the friction, thereby causing the lace 30 to remain tied. Furthermore, the fibers 38 can be made of a material with a relatively high coefficient of friction.

Figure 5:
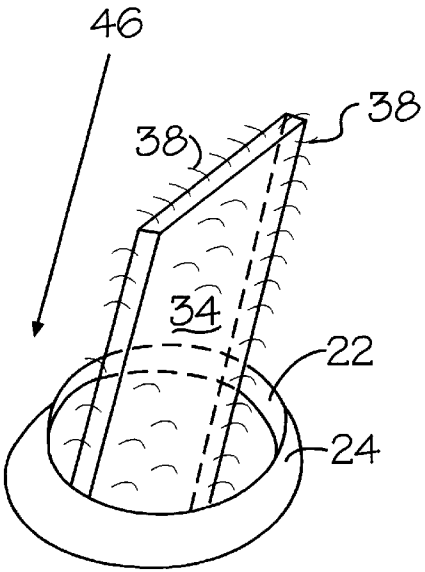
FIG. 5 depicts a partial, enlarged, perspective, in situ view of he alternative embodiment of the lace shown in FIG. 4, as it passes through the eyelet of a shoe.

Referring to FIG. 5, a portion of the yarn 34 of shoe lace 30 is shown passing (arrow 46) through one eyelet 24 of a plurality of typical eyelets for a shoe or sneaker (not shown). The fibers 38 have a low coefficient of friction with respect to the inner eyelet surface 22. It will be observed that the fibers 38 and, to a lesser extent, yarn 34 come into contact with the inner eyelet surface 22. The lace 30 can easily pass through the eyelet 24.

Figure 6:
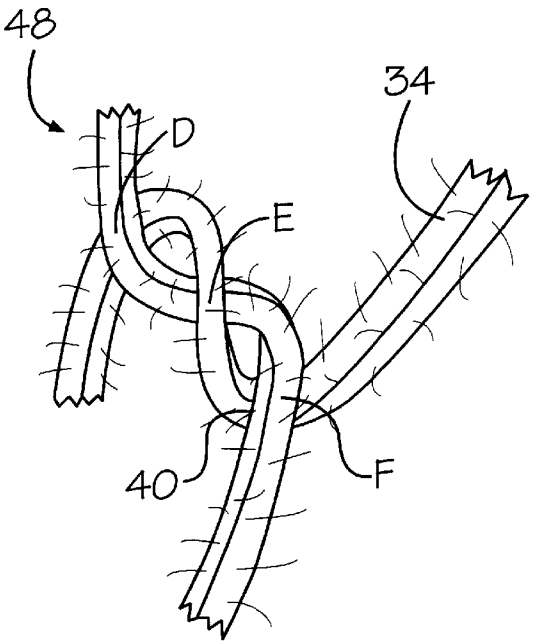
FIG. 6 shows an enlarged, perspective view of the alternative embodiment of the lace shown in FIG. 4, as it is tied into a knot.

Referring to FIG. 6, the yarn 34 is shown being tied into a knot matrix 48, in keeping with tying of the lace 30 about the front of a shoe or sneaker. For purposes of forming the knot matrix 48, the fibers 38 come into substantial contact with each other. Also, lace surfaces 42 come in contact at points "D", "E", and "F", as the knot matrix 48 is formed.

Figure 7:
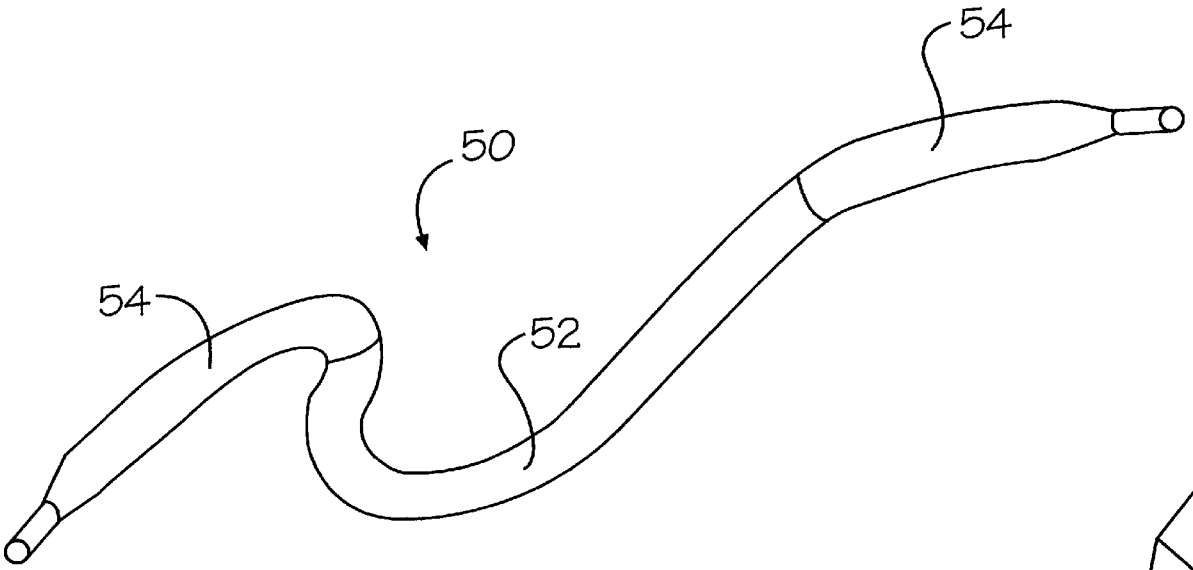
FIG. 7 illustrates a perspective view of another alternative embodiment of this invention.

Referring now to FIG. 7, shown is the shoe lace 50 of another embodiment of the invention in a perspective view. Lace 50 has a middle portion 52 having material properties different from end portions 54. Middle portion 52 is the part that, after the shoe is laced, is near or inside eyelet 24 (FIG. 5) and is made of material with a relatively low coefficient of friction.

End portions 54, having a relatively high coefficient of friction, are involved in the knotting or tying. The difference in friction between middle and end portions 52 and 54, respectively, is accomplished by using either different types of fibers (e.g., substantially frictionless material such as polytetrafluoroethylene (PTFE) for the middle of the laces, nylon for the end portions), different weaves, or both.

Figure 8:
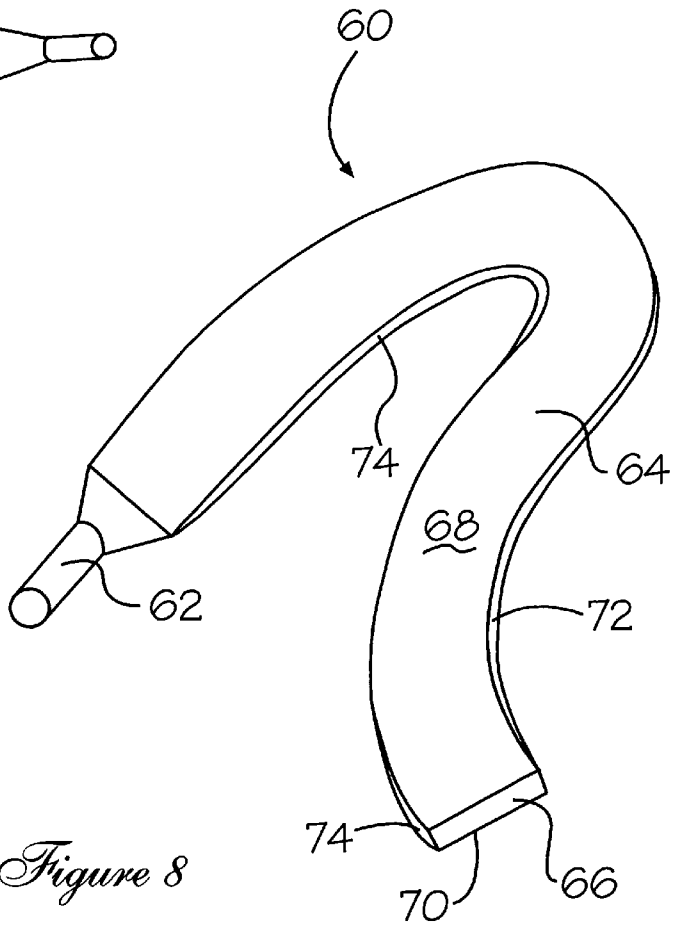
FIG. 8 illustrates a partial, enlarged, perspective view of another embodiment of the lace in accordance with the present invention.

Now referring to FIG. 8, the shoe lace 60 of another embodiment of the invention is illustrated in partial, enlarged, perspective view. The shoe lace 60 comprises a cylindrical, threading end cap 62 and a length of yarn 64 (shown herein cut short for viewing purposes). The length of yarn 64 has a rectangular cross-section 66, as illustrated at the cut end. The broader or wider paired sides 68 and 70, respectively, of the lace 60 are made with coarse or corded fibers to increase its friction. Slub or "friction bumps" may also be introduced into the weave of the respective sides 68 and 70 to increase the friction thereof.

The smaller, adjacently paired sides 72 and 74 are made smooth and relatively friction-free. This can be accomplished by using substantially frictionless material such as polytetrafluoroethylene (PTFE) threads or by coating these surfaces with substantially frictionless material such as polytetrafluoroethylene (PTFE).

The purpose of making adjacently paired surfaces (68, 70) and (72, 74), respectively, of the rectangular shaped yarn 64 is to provide different coefficients of friction to these surfaces. Thus, when threading the lace 60, the smooth surfaces 72 and 74 contact the eyelets of a shoe, allowing the lace 60 to be threaded easily. Alternately, the roughened sides 68 and 70 provide non-slippage during knotting of the yarn 64.

Figure 9:
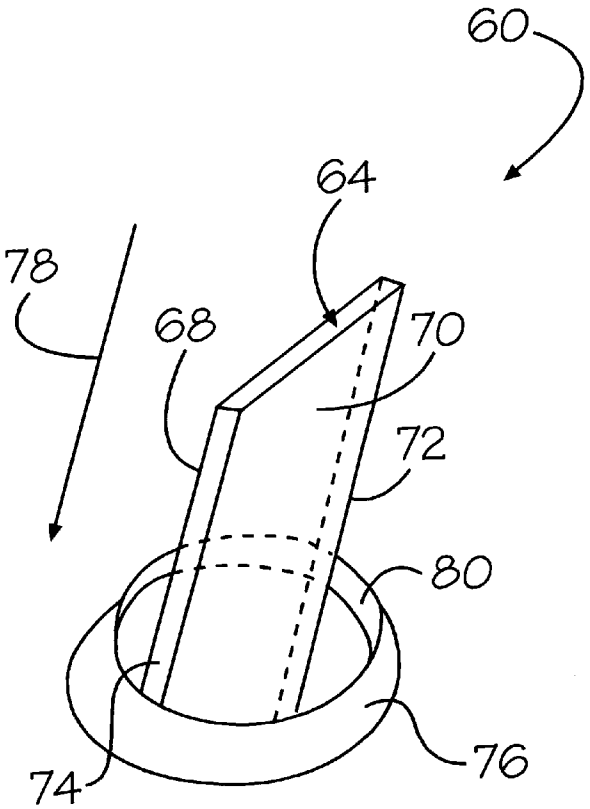
FIG. 9 depicts a partial, enlarged, perspective, in situ view of the embodiment of the lace shown in FIG. 8, as it passes through the eyelet of a shoe.

Referring to FIG. 9, a portion of the yarn 64 of shoe lace 60 is shown passing (arrow 78) through one eyelet 76 of a plurality of typical eyelets for a shoe or sneaker (not shown). Only the smooth, teflonized sides 72 and 74, respectively, come into contact with the inner eyelet surface 80. The yarn 64 easily passes through the eyelet 76 due to the reduced friction existing between the contacting surfaces 72 and 80, and surfaces 74 and 80, respectively. During the threading of lace 60 through the eyelet 76, the broader or wider sides 68 and 70, respectively, rarely touch the inner surface 80 of eyelet 76.

Figure 10:
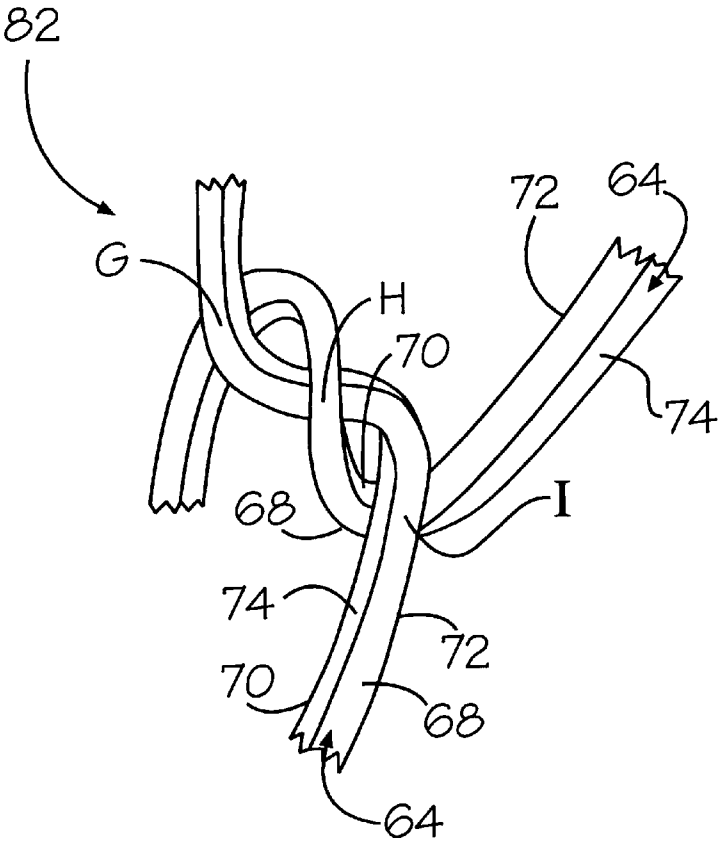
FIG. 10 shows an enlarged, perspective view of the embodiment of the lace shown in FIG. 8, as it is tied into a knot.

Referring to FIG. 10, the yarn 64 is shown being tied into a knot matrix 82, in keeping with tying of the lace 60 about the front of a shoe or sneaker. For purposes of forming the knot matrix 82, the upper and lower, wider frictional sides 68 and 70, respectively, come into substantial contact with each other at points "G", "H", and "I", as the knot matrix 82 is formed. The smoother, smaller sides 72 and 74 have minimal contact with each other and with the adjacent sides 68 and 70, barely influencing the formation of the knot matrix 82. Thus, the overall effect of the bifurcated frictional lace structure is to provide a knot matrix 82 that does not slip.

Although the lace of this invention has been described for footwear, it is conceivable that such a lace may also be usefully employed with other wearing apparel such as ski jackets, hoods, etc. Moreover, the lace can be flat, rectangular, polygonal, cylindrical, spherical, or asymmetrical, as befits its application(s).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A lace for footwear or apparel having eyelets, said lace comprising a length of lacing material for lacing said footwear or apparel and being movable for contact through said eyelets of said footwear or apparel, said length of material comprising upper and lower major surfaces, and side surfaces, comprising a first material, that are juxtaposed with respect to said upper and lower major surfaces, and which are smaller in area than said upper and lower major surfaces in order to reduce frictional force against said eyelets, each one of said upper and lower major surfaces comprising a with material having a uniformly higher coefficient of friction than said first material, so when said upper and lower major surfaces are formed into a knot, said upper and lower major surfaces will not slip out of the knot, while said side surfaces are substantially free to slide through said eyelets.

2. The lace for footwear or apparel in accordance with claim 1, wherein at least one of said major surfaces comprises slubs.

3. The lace for footwear or apparel or apparel in accordance with claim 1, wherein at least one of said major surfaces comprises coarse fiber.

4. The lace for footwear or apparel in accordance with claim 1, wherein at least one of said major surfaces comprises corded fiber.

5. A lace for footwear or apparel, said lace comprising a length of lacing material for lacing said footwear or apparel, said length of material having a substantially rectangular cross-section and first and second pairs of diametrically opposite sides, said first pair of diametrically opposite sides comprising a first material having a first coefficient of friction and being substantially smoothly movable for contact with eyelet surfaces, thus passing easily through said eyelets, said second pair of diametrically opposite sides comprising a second material having a second coefficient of friction and being uniformly rougher than said first pair of sides, as defined by a higher coefficient of friction, whereby said lace can form a non-slip knot.

6. The lace for footwear or apparel in accordance with claim 5, wherein said first material comprises a substantially frictionless-like material.

7. The lace for footwear or apparel in accordance with claims 5, wherein said second pair of sides comprises corded fiber.

8. The lace for footwear or apparel in accordance with claim 5, wherein said second pair of sides comprises slubs.

9. The lace for footwear or apparel in accordance with claim 5, wherein said second pair of sides comprises coarse fiber.

* * * * *